US005911225A

United States Patent [19]

Carty et al.

[11] Patent Number: 5,911,225

[45] Date of Patent: Jun. 15, 1999

[54] BRAID DETANGLING DEVICE

[76] Inventors: Jennifer Carty; Kenneth Carty, both of 600 E. 21st. St. #B9, Brooklyn, N.Y. 11226

[21] Appl. No.: 09/088,280

[22] Filed: Jun. 2, 1998

[51] Int. Cl.[6] ..... A45D 24/00

[52] U.S. Cl. ..... 132/119.1; 132/112

[58] Field of Search ..... 132/119.1, 112, 132/113, 114, 124, 143, 144, 150, 152, 155, 120, 108, 129, 136, 142, 271; 15/22.1, 22.2

[56] References Cited

U.S. PATENT DOCUMENTS

| | | | |
|---|---|---|---|
| 1,096,984 | 5/1914 | Alexander | 132/112 |
| 3,850,180 | 11/1974 | Rychkman, Jr. et al. | 132/137 |
| 3,850,181 | 11/1974 | Baker | 132/119.1 |
| 4,008,726 | 2/1977 | DiGiuseppe | 132/116 |
| 5,059,050 | 10/1991 | Guglielmo | 132/116 |
| 5,603,339 | 2/1997 | Brazeal et al. | 132/199.1 |
| 5,701,920 | 12/1997 | Taylor et al. | 132/212 |

*Primary Examiner*—Gene Mancene
*Assistant Examiner*—Pedro Philogene
*Attorney, Agent, or Firm*—Goldstein & Canino

[57] ABSTRACT

A braid detangling device for removing braids, comprising an elongated housing which serves to contain an electric motor, and first and second elongated teeth projecting in a perpendicular with respect to the housing. The first elongated tooth is fixedly attached to the housing and the second elongated tooth is movable between a retracted position wherein the two teeth are immediately adjacent to each other and an extended position wherein the two teeth are spread away from each other. A drive mechanism of any suitable type is provided within the housing adapted to apply a drive from the electric motor to oscillate the second tooth between the extended and retracted positions. The first and second teeth have pointed end adapted to be inserted into densely interwoven strands of hair. In use, the pair of teeth are inserted into a braid while they are in the retracted position and subsequent expanding motion of the second tooth pushes interwoven strands of hair away from each other and thereby resulting in disentanglement of a portion of the braid.

1 Claim, 2 Drawing Sheets

BRAID DETANGLING DEVICE

BACKGROUND OF THE INVENTION

This invention relates to a braid detangling device. More particularly, the invention relates to a device having a pair of perpendicularly projecting teeth which oscillate between retracted and extended positions to loosen braids.

Braids have become increasingly popular, especially with people who have short hair since any desired length and style can be achieved using manufactured strands of hair. Typically, these manufactured strands of hair are attached to natural hair on the scalp, and braids can be formed by interweaving the attached strands of hair in an alternating fashion. One drawback to braids is the amount of time necessary to remove the braids when changing of the hair style is desired. The problem associated with removal of braids is more prevalent among people who have longer braids.

Accordingly, in an attempt to solve the problems associated with removal of braids, several references uncovered in the prior art describe devices designed for detangling hair that has been styled into braids. For example, U.S. Pat. No. 5,307,825 to Smith discloses a hair grooming device including a handle portion and a tapered parting member extending longitudinally from one end of the handle portion, wherein the parting member has at least one transverse tooth extending from the parting member that is used for applying various hair styling fluids to the hair. Likewise, U.S. Pat. No. 3,870,056 to Stemme discloses a hair detangling device having a pair of parallel combs mounted for reciprocating movement along their length in opposite direction.

Despite these prior art devices, there is still a further need to provide an improved braid detangling device. Such a braid detangling device should allow an individual to disentangle braids in lesser amount of time than if the braids were removed manually. Moreover, such a braid detangling device should incorporate a pair of elongated teeth which oscillate toward and away from each other designed to loosen interwoven strains of hair without causing damages to the hair.

While these units mentioned above may be suitable for the particular purpose employed, or for general use, they would not be as suitable for the purposes of the present invention as disclosed hereafter.

SUMMARY OF THE INVENTION

It is an object of the invention to provide a braid detangling device which allows an individual to detangle braids in lesser amount of time than if the braids were removed manually.

It is another object of the invention to provide a braid detangling device incorporating a pair of elongated teeth projecting perpendicular from one end of the housing which oscillate toward and away from each other to loosen interwoven strains of hair and thereby resulting in relatively rapid disentanglement of braids without causing damages to the manufactured or natural strands of hair.

It is yet another object of the invention to provide a braid detangling device which includes with a speed control unit to permit a user to manually select the speed with which the teeth oscillate.

It is a further object of the invention to provide a braid detangling device, wherein each of the teeth has pointed end adapted for easy insertion into densely interwoven strands of hair.

The invention is a braid detangling device for removing braids, comprising an elongated housing which serves to contain an electric motor, and first and second elongated teeth projecting in a perpendicular with respect to the housing. The first elongated tooth is fixedly attached to the housing and the second elongated tooth is movable between a retracted position wherein the two teeth are immediately adjacent to each other and an extended position wherein the two teeth are spread away from each other. A drive mechanism of any suitable type is provided within the housing adapted to apply a drive from the electric motor to oscillate the second tooth between the extended and retracted positions. The first and second teeth have pointed end adapted to be inserted into densely interwoven strands of hair. In use, the pair of teeth are inserted into a braid while they are in the retracted position and subsequent expanding motion of the second tooth pushes interwoven strands of hair away from each other and thereby resulting in disentanglement of a portion of the braid.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
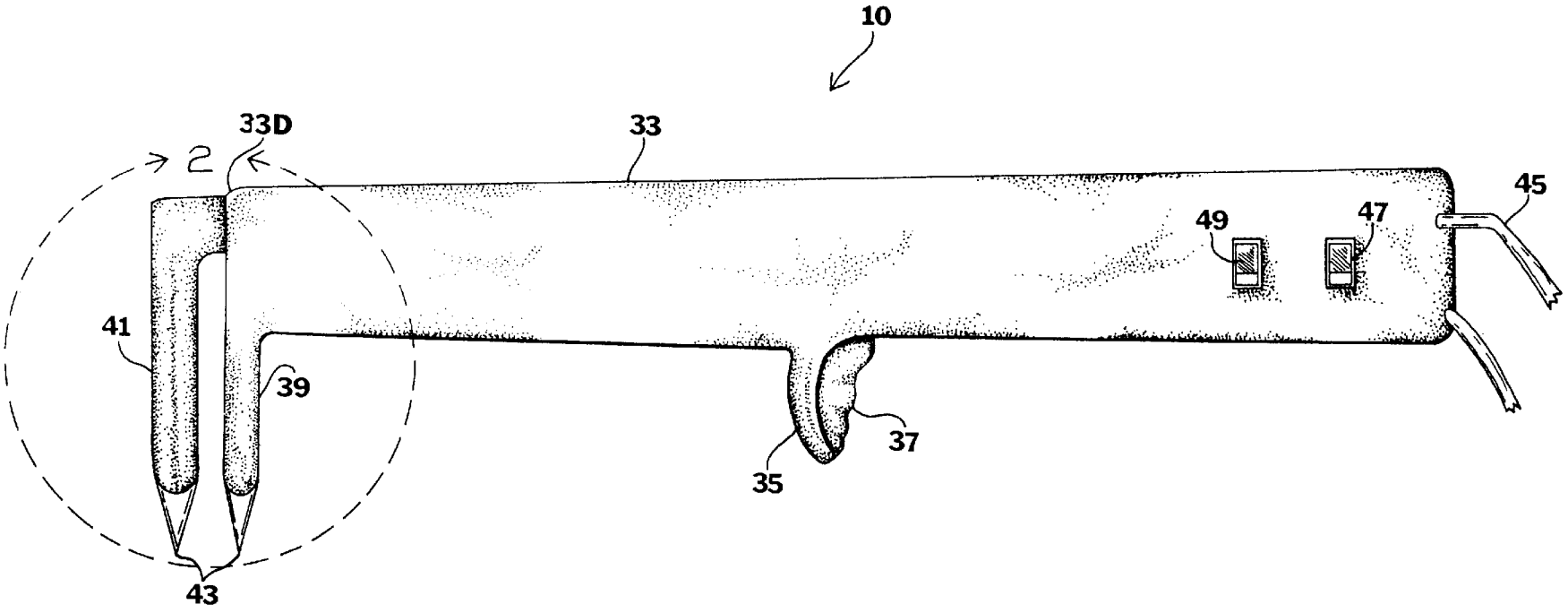
FIG. 1 is a side elevational view of the braid detangling device in accordance with the preferred embodiment of the present invention.

FIG. 1 illustrates a preferred embodiment of a braid detangling device 10 in accordance with the principles of the present invention. As will be seen in following paragraphs, the braid detangling device 10 is designed to loosen interwoven strains of hair in a relatively rapid manner without causing damages to the hair.

Figure 2:
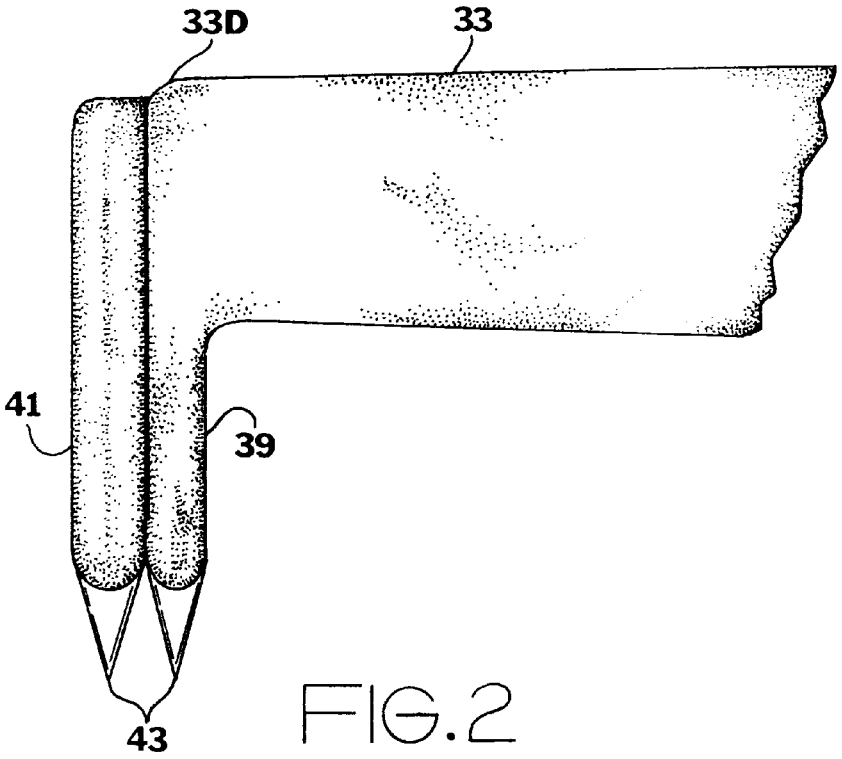
FIG. 2 is an enlarged side elevational view of the area indicated in the circle 2 in FIG. 1, illustrating a pair of elongated teeth in a retracted position.
Figure 3:
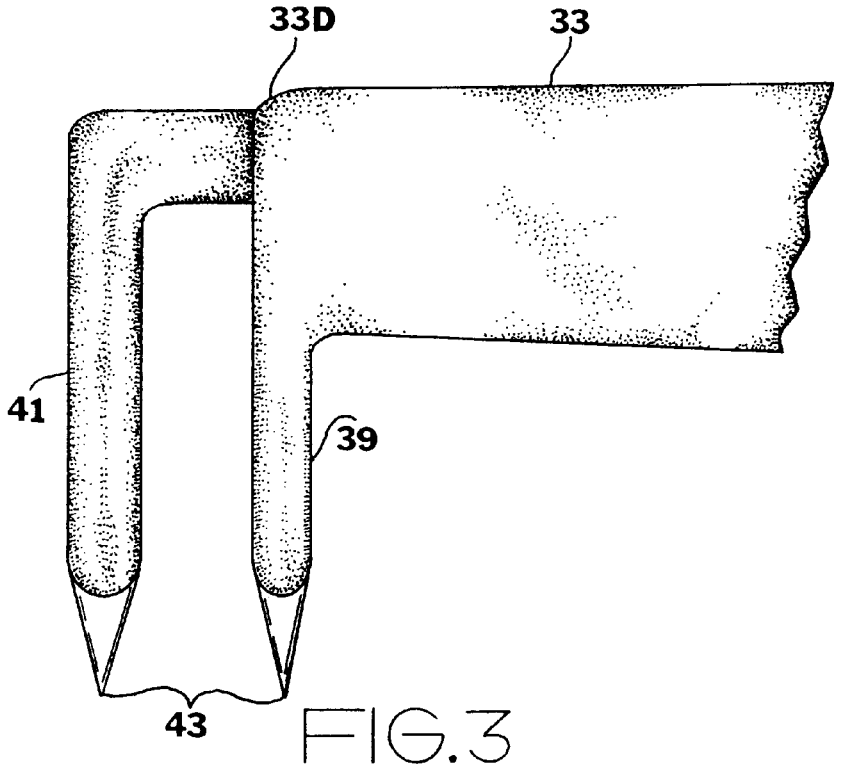
FIG. 3 is an enlarged side elevational view of the area indicated in the circle 2 in FIG. 1, illustrating the pair of elongated teeth in an extended position.

The braid detangling device 10 comprises a housing 33, and a handle 35 attached to the housing 33 which is provided with finger grip 37 to allow a user to hold the handle 35 more comfortably during operation of the device 10. As shown in FIG. 1, first 39 and second 41 elongated teeth project in a perpendicular with respect to a distal end 33D of the housing 33, wherein the first elongated tooth 39 is fixed attached to the distal end 33D of the housing 33. The second elongated tooth 41 is coupled to a drive mechanism and is movable between a retracted position wherein the first 39 and second 41 teeth are aligned immediately adjacent to each other, as shown in FIG. 2, and an extended position wherein the two teeth 39 and 41 are spread away from each other, as shown in FIG. 3. Each of the elongated teeth 39 and 41 has pointed end 43 adapted for easy insertion into densely interwoven strands of hair. However, the pointed ends 43 are preferably not so sharp that it will cause scratching of user's scalp.

An electric motor of any suitable type is provided in the housing 33, which may be powered by any suitable power source such as batteries, rechargeable batteries, or together with suitable transformer apparatus, a 120 volt household power source 45. A drive mechanism is operatively coupled between the motor and the second tooth 41 adapted to apply a drive from the electric motor to oscillate the second tooth 41 in an axial direction between the extended and retracted positions, as seen by referring to FIGS. 2 and 3. The drive mechanism of the present invention is preferably of the type well known to persons of ordinary skill in the art and forms no part of the present invention.

A switch 47 is provided on the housing 33 for manually operating the braid detangling device 10 on and off. The housing 33 includes electrical conductors to electrically connect the motor, the power source, and the switch in series whereby the motor is energized by the power source under the control of the switch to move the second tooth 41 repetitively toward and away from the first tooth 39. The braid detangling device 10 may also include a control unit 49 of any suitable type to allow a user to manually select the speed with which the second tooth 41 is to be oscillated.

The operation of the braid detangling device 10 will now be described. The pair of elongated teeth 39 and 41 are inserted into a braid while they are in the retracted position and subsequent spreading motion of the second tooth 41 pushes interwoven strands of hair away from each other and thereby resulting in disentanglement of a portion of the braid. This process is repeated by progressively moving the elongated teeth of the present device upwardly along the braid until the entire length thereof has been disentangled. In this manner, the braid detangling device 10 permits users to loosen their braids in a relatively rapid manner without causing damages to the braided hair.

While the embodiments of the present invention are disclosed in relation to the braid detangling device wherein the second tooth oscillates longitudinally with respect to the first tooth, it will be appreciated by those skilled in the art that the braid detangling device disclosed herein can be easily modified such that the pair of teeth oscillates laterally with respect to each other, instead of having one tooth extending and retracting longitudinally with respect to the other tooth. Many specific details contained in the above description merely illustrate some preferred embodiments and should not be construed as a limitation on the scope of the invention. Many other variations are possible.

What is claimed is:

1. A braid detangling device, comprising:

an elongated housing having a distal end;

a single first tooth fixedly located the distal end of the housing, the first tooth extending perpendicular to the housing;

a single second tooth perpendicularly mounted at the distal end of the housing, beyond the first tooth, extending parallel to the first tooth;

the first tooth and second tooth both have pointed ends opposite the housing; and wherein the second tooth is capable of repetitive, reciprocal motion between a retracted and an extended position, when in the extended position, the teeth are a distance away from each other, when in the retracted position, the teeth are located immediately adjacent one another, whereby the second tooth is never in a position closer to the distal end of the housing than the first tooth.

* * * * *